US011680781B2

(12) United States Patent
Parker et al.

(10) Patent No.: US 11,680,781 B2
(45) Date of Patent: Jun. 20, 2023

(54) ENHANCED PERFORMANCE AMMUNITION

(71) Applicant: BAE SYSTEMS plc, London (GB)

(72) Inventors: Simon France Parker, Crewe (GB); Kyle Bridgeman, Crewe (GB)

(73) Assignee: BAE SYSTEMS plc, London (GB)

( * ) Notice: Subject to any disclaimer, the term of this patent is extended or adjusted under 35 U.S.C. 154(b) by 121 days.

(21) Appl. No.: 17/593,580

(22) PCT Filed: Feb. 19, 2020

(86) PCT No.: PCT/GB2020/050396

§ 371 (c)(1),
(2) Date: Sep. 21, 2021

(87) PCT Pub. No.: WO2020/193935

PCT Pub. Date: Oct. 1, 2020

(65) Prior Publication Data

US 2022/0178666 A1 Jun. 9, 2022

(30) Foreign Application Priority Data

Mar. 25, 2019 (EP) ..... 19275032
Mar. 25, 2019 (GB) ..... 1904047

(51) Int. Cl.

| | |
|---|---|
| ***F42B 12/06*** | (2006.01) |
| ***F42B 12/08*** | (2006.01) |
| ***F42B 12/74*** | (2006.01) |
| ***F42B 12/78*** | (2006.01) |

(52) U.S. Cl.
CPC ..... *F42B 12/06* (2013.01); *F42B 12/08* (2013.01); *F42B 12/74* (2013.01); *F42B 12/78* (2013.01)

(58) Field of Classification Search
CPC ..... F42B 12/06; F42B 12/08; F42B 12/74; F42B 12/78
(Continued)

(56) References Cited

U.S. PATENT DOCUMENTS 4,338,862 A * 7/1982 Kwatnoski ..... F42B 12/78 102/501
6,973,879 B1 * 12/2005 McElroy ..... F42B 12/76 102/501
(Continued)

FOREIGN PATENT DOCUMENTS

EP 2636985 A1 9/2013
EP 3467427 A1 4/2019
(Continued)

OTHER PUBLICATIONS

International Search Report and Written Opinion received for PCT Application No. PCT/GB2020/050396. dated Mar. 17, 2020. 9 pages.
(Continued)

*Primary Examiner* — Samir Abdosh
(74) *Attorney, Agent, or Firm* — Finch & Maloney PLLC

(57) ABSTRACT

This invention relates to a combination of a gun having a rifled barrel and a round of enhanced performance ammunition, and to a projectile for use in the combination. The invention is especially, but not exclusively related to a projectile with a nominal calibre, for use in a rifled barrel, the projectile comprising: an elongate metal core, a ceramic tip with a Vickers Hardness greater than said metal core, said ceramic tip abutted with one end of the elongate metal core, wherein a deformable jacket or deposited coating, surrounds the elongate metal core and ceramic tip, such that said jacket or coating defines the nominal calibre of said projectile.

20 Claims, 3 Drawing Sheets

Figure 1:
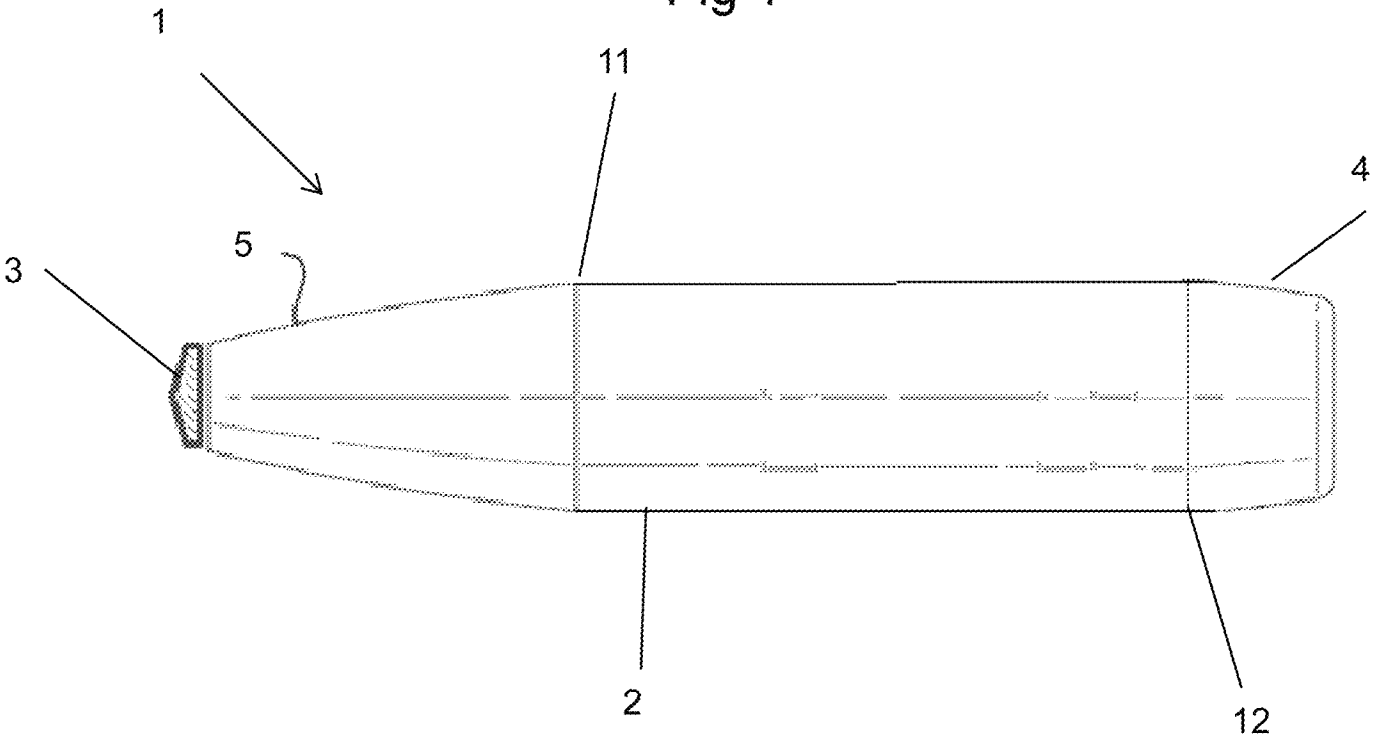

(58) Field of Classification Search
USPC ..... 102/517
See application file for complete search history.

(56) References Cited

U.S. PATENT DOCUMENTS

| | | | | |
|---|---|---|---|---|
| 8,316,772 | B1 * | 11/2012 | Gold | F42B 12/22 102/473 |
| 9,587,918 | B1 * | 3/2017 | Burrow | F42B 12/78 |
| 2018/0209768 | A1 * | 7/2018 | Peterson | F42B 5/067 |
| 2018/0224249 | A1 * | 8/2018 | Carbone | F42B 10/46 |
| 2019/0017791 | A1 | 1/2019 | Conroy | |
| 2019/0113319 | A1 * | 4/2019 | Forsell | F42B 12/08 |
| 2020/0256654 | A1 * | 8/2020 | Burrow | C22C 1/0458 |
| 2022/0178666 | A1 * | 6/2022 | Parker | F42B 12/08 |

FOREIGN PATENT DOCUMENTS

| | | | |
|---|---|---|---|
| WO | 9910703 | | 3/1999 |
| WO | 2004085954 | A1 | 10/2004 |
| WO | 2005017442 | A1 | 2/2005 |
| WO | 2020193935 | A1 | 10/2020 |

OTHER PUBLICATIONS

GB Search Report under Section 17(5) received for GB Application No. GB1904047.6, dated Aug. 22, 2019. 3 pages.
Extended European Search Report received for EP Application No. 19275032.1, dated Oct. 4, 2019. 7 pages.
International Preliminary Report on Patentability received for PCT Application No. PCT/GB2020/050396. dated Oct. 7, 2021. 7 pages.

* cited by examiner

ENHANCED PERFORMANCE AMMUNITION

This invention relates to a combination of a gun having a rifled barrel and a round of enhanced performance ammunition, and to a projectile for use in the combination. The invention is especially, but not exclusively related to an improved form of projectile for small arms ammunition.

When a projectile is fired from a rifled barrel, the projectile must deform as it travels along the barrel so that material forming part of the projectile is forced into the spaces between the lands that form the rifling. This process is called engraving, and causes a spin to be imparted to the projectile by virtue of the twist of the rifling.

The deformation of the projectile, its travel along the barrel effectively as a force fit to the rifling, the high linear acceleration imparted by the gun propellant on firing, and the consequent high rate of angular acceleration and associated force acting between rifling and projectile all contribute to substantial wear on the barrel.

If this wear rate can be reduced, substantial benefits follow, including increased barrel life, higher muzzle velocity and hence increased accuracy and lethality.

For this reason, low friction, soft, readily deformable materials are normally selected for small arms bullet. This was originally achieved by the use of solid lead bullets but these have now been almost universally replaced by a bullet comprising of a gilding metal jacket and lead core.

According to the present invention there is provided a projectile with a nominal calibre, for use in a rifled barrel, the projectile comprising:

an elongate metal core, a ceramic tip with a Vickers Hardness greater than said elongate metal core, said ceramic tip abutted with one end of the elongate metal core, wherein a deformable jacket or deposited coating, surrounds the elongate metal core and ceramic tip, such that said jacket or coating defines the nominal calibre of said projectile.

The use of a ceramic allows for a very high hardness material to be used to allow defeat of a target, however whilst an elongate core may be formulated entirely from a ceramic, the density may be lower in comparison, which would compromise on the momentum of the projectile. The use of metal in the elongate metal core, allows the mass of the projectile round to be raised and thereby to ensure that the ballistic properties are maintained.

The elongate metal core may be selected from one of lead, steel, tungsten, alloys of tungsten, or tungsten carbide. The use of high Vickers Hardness steels as elongate cores are known, however they are more costly, and so a greater range of metals may be selected, to allow the mass to be retained, and the exceptionally high hardness of a ceramic to be used to provide the penetrative effect.

In one arrangement the elongate core may be lead with a ceramic tip to provide a high hardness penetration capability.

In a further arrangement the elongate core may be a metal, other than lead, such as, for example a high hardness metal in combination with a ceramic tip to provide a high hardness penetration capability. There is a desire to reduce the presence of lead from ammunition, preferably the elongate core is lead free.

The elongate core may have a hardness of greater than 100 HV.

The ceramic tip may be any inorganic compound of a metal, non-metal or metalloid ceramic, such as, for example, an oxide, non-oxide, or composite cermet. The ceramic may be oxides of alumina, yttria, beryllia, ceria, zirconia, titania, or non-oxides such as, for example carbides, borides, nitrides, silicide, preferably yttria, zirconia, or non-oxides such as carbides, and nitrides.

The density of the ceramic tipped penetrator may affect the overall bullet mass, which may affect the projectile's ballistic properties.

The ceramic may have density of greater than 4000 $kg/m^3$, more preferably a density greater than 5000 $kg/m^3$, more preferably in the range of 7000 to 8000 $kg/m^3$. In one arrangement the ceramic material may have a density close to that of steel The ceramic tip may be selected to have Vickers hardness greater than greater than 570HV, more preferably greater than 1000 HV.

Preferably the ceramic tip may have a Vickers Hardness of greater than 570 HV, more preferably 1000 HV and a density of greater than 5000 $kg/m^3$, more preferably in the range of 7000 to 8000 $kg/m^3$.

The ceramic may also have high fracture toughness, flexural strength, tensile strength and compressive strength in relation to a high hardness steel penetrator as a comparator material.

The following are examples of ceramics which provide densities at least comparable with a steel alloy, and thereby mitigate issues of change of ballistic properties of the round, due to a reduction in mass. Therefore with these examples, he overall mass of the core, may be kept in line with the standard elongate core material.

Zirconia (partially stabilised with Magnesium Oxide) has a high density in comparison to many ceramics, thereby providing a good ballistic match. Further the material has a high hardness at over 1000 HV. It comprises a high compressive strength greater than 1750 MPa. Good tensile strength in comparison to other ceramics, and a modulus of elasticity at least equal to that of steel.

Sintered and Injection Moulded Zirconia partially stabilized with Yttria Oxide, comprises a high density in comparison to other ceramics (good for ballistic match). It comprises a high hardness greater than 1000 HV, high compressive strength greater than 2500 MPa. Good tensile strength in comparison to other ceramics. The modulus of elasticity is similar to at least that of steel alloys, is one of the highest fracture toughness ceramics, and has a high flexural strength at 1240 MPa.

Hot Isostatic Pressed Zirconia (partially stabilized with Yttria Oxide) one of the highest density ceramics, thereby providing excellent ballistic match. In comparison with the other Zirconias, it has a high hardness greater than 1000 HV, and a high compressive strength greater than 2500 MPa. Good tensile strength in comparison to other ceramics. The modulus of elasticity is comparable to that of at least steel. Hot Isostatic Pressed Zirconia has one of the highest fracture toughness ceramics and one of the highest flexural strengths at 1720 MPa.

Silicon Nitride has a high hardness value, which is greater than 1000 HV, and with a high compressive strength greater than 2500 MPa. This is a high tensile strength material and is comparable to zirconia ceramics, with a modulus of elasticity greater than that of steel.

The ceramic tip may be formed by any known process such as for example additive layer manufacture, plasma deposition, solidification of molten salts, chemical synthesis, sintering, isostatic pressing or injection moulding.

The ceramic tip may be pre-formed into its final shape and abutted against the elongate metal core, prior to the formation of the metal jacket or deposed outer coating. To allow high speed manufacturing of the projectile round, the ceramic tip may preferably be pre-formed to allow rapid construction.

The ceramic tip may comprise a physical and/or chemical bond to the elongate metal core. The bond between the elongate core and ceramic tip may be fusion, adhesive, plasma deposition, additive layer manufacture.

The ceramic tip may be formed, (i.e. deposed) directly onto the elongate metal core by plasma deposition, additive layer manufacture to build up a final form shape or a near final form shape, which may undergo further steps of standard ceramic manufacture such as solidification of molten salts, chemical synthesis, sintering, isostatic pressing.

The ceramic tip may have a first end which engages with the metal core and a second end which has a taper with respect to the first end. The final projectile round comprises a nominal front end with an ogival portion forming the front of the body of the round, the ceramic tip being located at the end of the metal core orientated towards the ogive section, such that the tapered end of the ceramic tip may be located in the ogive section.

The ceramic tip may have any shape, such as for example frustroconcial, conical, pyramidal, or cylindrical, preferably the outer edge of the ceramic tip conforms to the inner surface of the ogive of the deformable jacket, thereby avoiding the high hardness material of the ceramic tip from tearing the gliding metal of the deformable jacket.

The ceramic tip may comprise from 1% to 99% of the fill volume of the inner cavity in projectile, preferably in the range of 5% to 50%, more preferably in the range of 5 to 25%, more preferably less than 10%.

The use of a ceramic tip, rather than a core comprising 30 to 50% mass of the total mass of the core, allows for only minor modification to the existing core of a round.

The elongate cylindrical core may have substantially parallel sides.

The deformable jacket or coating surrounds the elongate core and ceramic tip, which defines an outer diameter of said projectile.

The coating may be an electrodeposited coating, however the deposition techniques are designed to provide a metal which closely aligns to the elongate metal core and ceramic tip, and therefore removes the small cavities which exist between the ogival portion and the remainder of the elongate core. The deposited coating may provide better transfer of spin from the outer metal coating to the elongate metal core and ceramic tip.

The elongate core and/or ceramic tip may comprise one or more bands or cannelures located circumferentially thereon, said bands protruding radially outward therefrom, to provide engagement with the coating or deformable jacket.

The deformable jacket may typically be a gilding metal jacket, typically copper or alloys thereof. The jacket may comprise, a metal jacket, formed from an extrudable outer sheath which is pressed through a series of dies, and forms around the elongate metal core and ceramic tip. In a highly preferred arrangement the jacket is located over the elongate metal core and ceramic tip.

There may be a cavity created between the jacket and the ceramic tip. The cavity may be filled with metal salts, powdered ceramic, or left unfilled.

The ceramic tip may provide a means of identification of the origin of the round, once fired. There is provided a method of identification of the origin of a fired projectile, by identifying the composition of the ceramic tip material, and/or a dopant or taggant incorporated therein; in said ceramic. The identification may be to identify the manufacturer, for the purposes of authenticity, anti-counterfeit, and/or origin of the user using the round. The dopant or taggant may be added to the ceramic tip material, to form part of the ceramic matrix, or it may be an inert additional reagent, which is simply bound within the final ceramic composition. The dopant or taggant may comprise a unique identifier.

The outer diameter of said projectile is substantially equal to an internal diameter of the barrel defined by the lands, and wherein during firing of the projectile the lands of the rifling in the barrel deform the deformable jacket or coating. Upon firing, deformation of the jacket is designed to provide the projectile with an interference fit with the rifling lands rifling so as to provide effective obturation by restricting or preventing the escape of propellant gases past the projectile via the rifling grooves.

According to a further aspect of the invention there is provided a combination of a gun having a rifled barrel and a round of ammunition as defined herein, the rifling of the barrel comprising rifling grooves which are separated by lands extending helically along a length of the barrel; the projectile having an outer diameter substantially equal to or less than an internal diameter of the barrel defined by the lands. The combination provides an arrangement such that wherein upon firing deformation of the jacket or coating provides the projectile with an interference fit with the rifling lands rifling so as to provide effective obturation by restricting or preventing the escape of propellant gases past the projectile via the rifling grooves.

Normally, the projectile will also have an ogival nose portion of the body forward of said substantially elongate cylindrical core, although other forms are possible.

The body of the projectile (i.e. excluding the deformable jacket) should have a diameter which is not greater than that defined by the rifling lands. The length and precise diameter of the projectile is designed to provide the best fit.

Regard must also be taken to ensure that the force required to effect the deformation of the jacket material and to propel the projectile along the barrel is not excessive, and therefore the diameter of the elongate metal core and ceramic tip may not be greater than that of the rifling lands.

In high volume conditions, elongate metal core materials of lead or steel are suitable materials, as they are inexpensive and can be readily formed into the desired shapes.

The invention is particularly but not exclusively applicable to small arms weapons systems, having a nominal calibre of 20 mm or less, such as for example, 12.7 mm, 9 mm or less, such as 7.62 mm, 5.56 mm and 4.6 mm.

Figure 2:
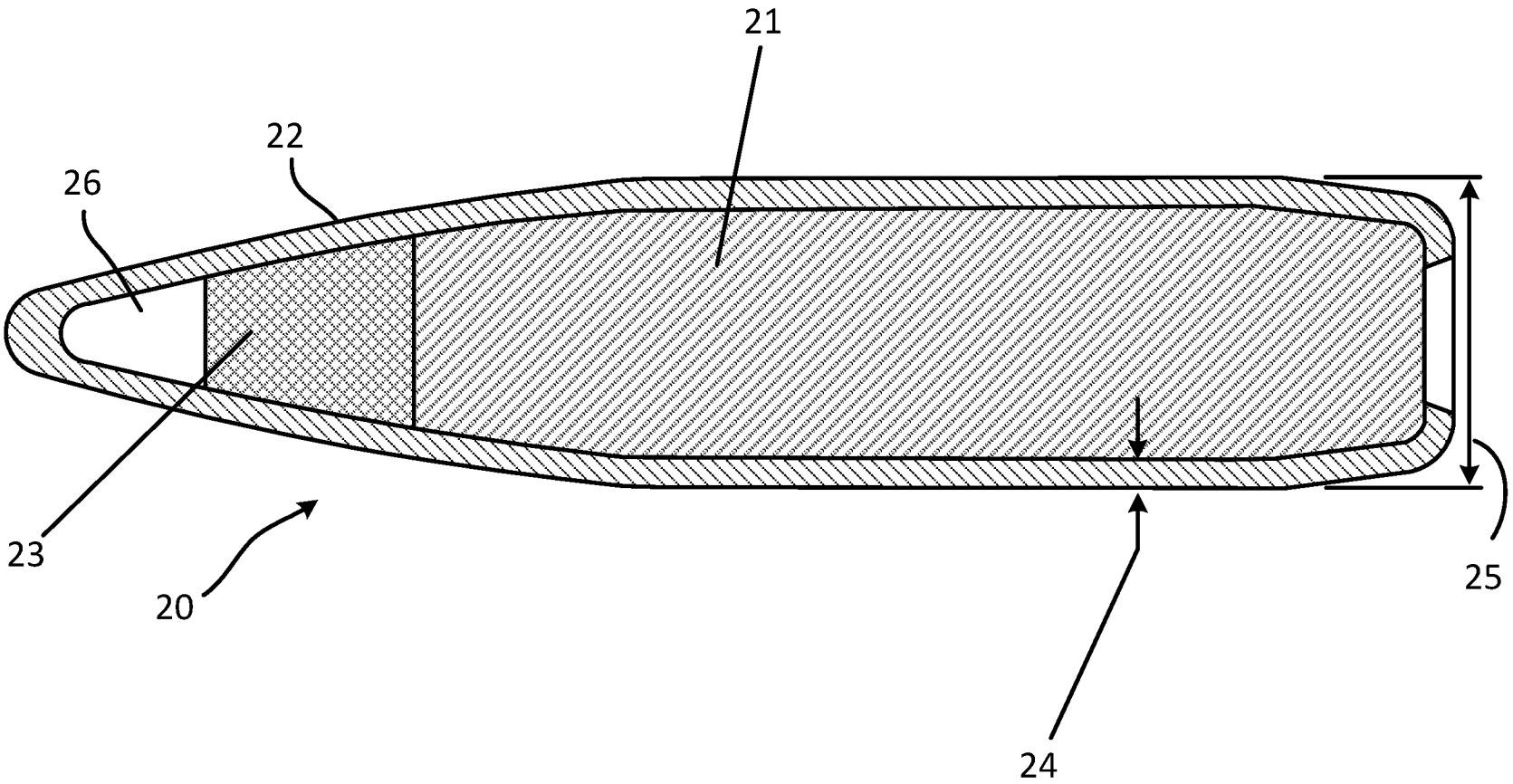
Figure 3:
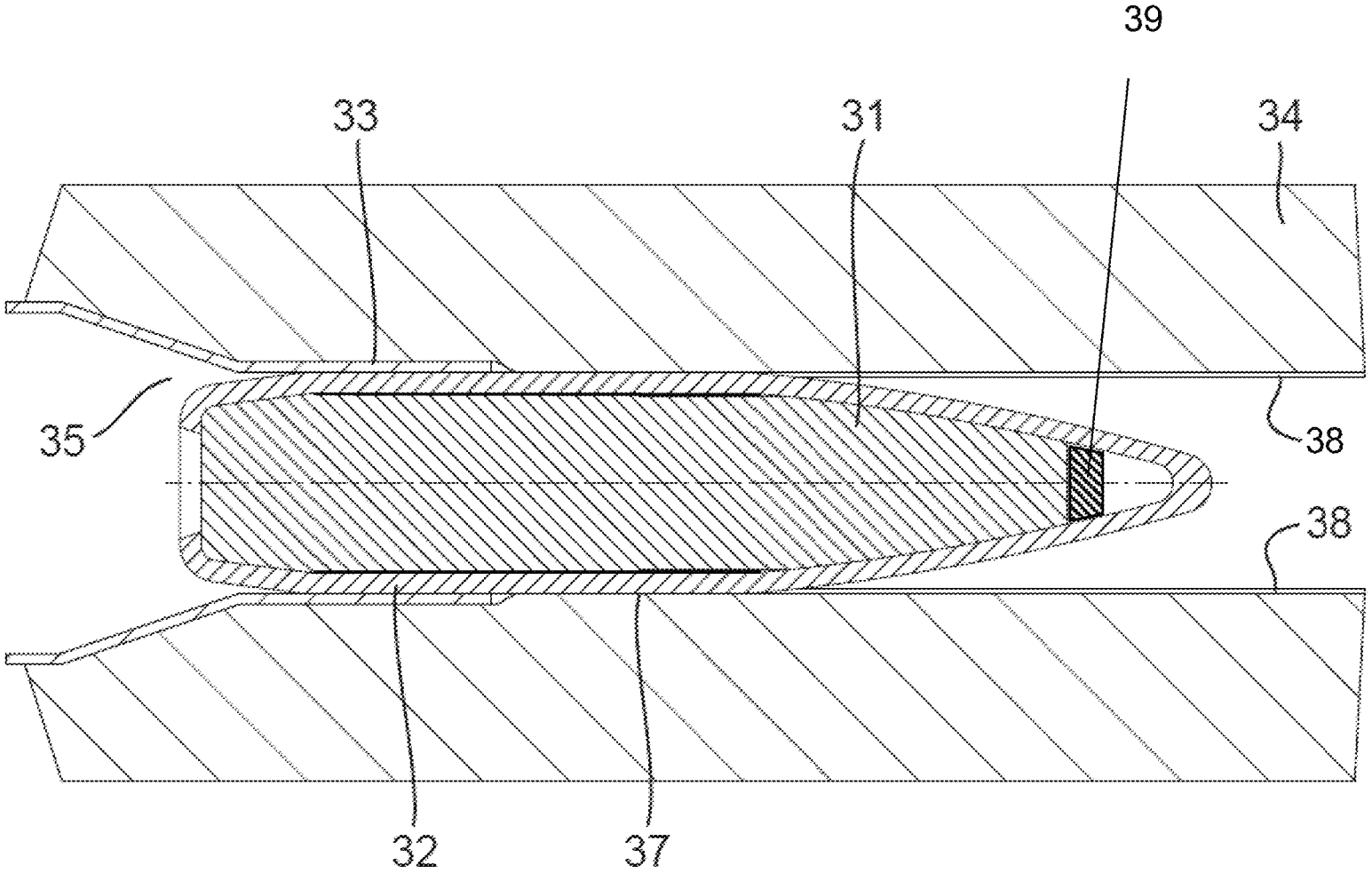

The invention will now be described by way of example only with reference to the accompanying drawings, of which:

FIG. 1 shows a diagrammatic representation of a elongate metal core and ceramic tip; and FIG. 2 shows the projectile shown in FIG. 1, with a jacket thereon FIG. 3 shows, in section, the jacketed projectile and part of the cartridge case located in the chamber of a gun having a rifled barrel and ready for firing.

As shown in FIG. 1, a small arms core 1 comprising an elongate metal core 2 and ceramic tip 3 comprising an elongate cylindrical core 3, an ogival portion 5, and a rearwardly located boat tailed portion 4.

The ogival portion 5 abuts the elongate cylindrical core 2, at a point of intersection 11. The point of intersection 11 is the point where the elongate cylindrical core has substantially parallel sides.

The boat tail section 4 abuts the elongate cylindrical core 2, at the rear edge 12.

The elongate metal core 2 is of elongate form and may preferably be cold formed from steel having a Vickers Hardness of at least 550, more preferably 570 HV. It can subsequently be given a heat treatment to provide the desired hardness or other physical properties. Alternatively it may be lead.

Because of the substantial hardness of the ceramic tip 3, the projectile is highly effective at penetration of targets such as titanium/Kevlar body armour. Moreover, the high hardness also serves to minimise ablation of the projectile tip profile, thus further contributing to its effectiveness in target penetration.

FIG. 2 show the projectile 20 which comprises the elongate metal core 21 and ceramic tip 23 (as exemplified in FIG. 1), with a jacket 22, located thereon. The jacket 22 has a thickness 24, selected to provide the desired outer diameter for the nominal calibre of the gun, from which it is to be fired.

When the elongate metal core 21, ceramic tip 23 and deformable jacket 22 passes from the gun chamber into the rifled part of the barrel, by virtue of its outer diameter 25, the jacket 22 is deformed by the lands of a rifled barrel. The outer diameter 25 of the jacket material 22 should be substantially equal to the diameter of any rifling grooves (not shown).

In the arrangement shown, the elongate metal core 21 and ceramic tip 23, is covered by the jacket 22, which is extruded over the elongate metal core 21 and ceramic tip, and creates a cavity 26. The cavity 26 may be empty, filled with inert powder or completely filled by the ceramic tip.

Therefore, despite the hardness of the elongate metal core 21, (if selected from a high hardness steel), and especially the ceramic tip 23, barrel wear from this factor is minimised.

It will be evident to the skilled addressee that all of these factors reducing the engraving force will also result in reduced barrel wear, higher muzzle velocity, and hence increased lethality and accuracy.

The optimum design parameters for the projectile according to the invention can be determined by those skilled in the art, based on the teaching contained herein.

The invention is particularly but not exclusively applicable to small arms ammunition.

As shown in FIG. 3, in use the round of ammunition comprising the assembled primed and filled (shown in part) cartridge case 33, together with a projectile 31 are fired from a gun having a rifled barrel 34, in the conventional manner, i.e. by chambering the round within the gun chamber 35, and arranging for the primer cap (not shown) to be struck by a firing pin.

When the elongate metal core 31 and ceramic tip 39 and associated jacket 32 passes from the gun chamber into the rifled part of the barrel, by virtue of its greater diameter, the jacket 32 becomes engraved by the rifling 37. The diameter of the elongate metal core 31 and ceramic tip 39 and associated jacket 32 should preferably be substantially equal to or less than the diameter of the rifling grooves 38.

The jacket 32 is of a malleable material which may be copper or a copper alloy and could additionally comprise an outer layer of a low-friction material such as molybdenum disulphide. This jacket 32 is of a thickness greater than the depth of the rifling grooves, and is of a relatively softer material than that of the elongate metal core 31 and ceramic tip 39, it can also engrave more readily, and thus contribute for this reason also to a reduction in the engraving force required. Because the jacket 32 is thicker than the depth of rifling, engraving can take place entirely within the coating so that the hard metal of the elongate metal core 31 and especially the ceramic tip 39 is kept substantially out of contact with the material forming the rifling of the gun barrel. Therefore, despite the hardness of the ceramic tip 39, barrel wear from this factor is minimised.

The invention claimed is:

1. A projectile with a nominal calibre, for use in a rifled barrel, the proj ectile comprising:

an elongate metal core;

a ceramic tip with a Vickers Hardness greater than said elongate metal core, said ceramic tip abutted with one end of the elongate metal core; and a deformable jacket or coating that surrounds the elongate metal core and the ceramic tip, such that said deformable jacket or coating defines the nominal calibre of said projectile;

wherein said deformable jacket or coating defines an inner cavity in the proj ectile, and the ceramic tip is in a range of from 5 to 25% of a fill volume of the inner cavity.

2. The projectile according to claim 1, wherein the elongate metal core is selected from one of lead, steel, tungsten, an alloy of tungsten, or tungsten carbide.

3. The projectile according to claim 1, wherein the ceramic tip is an inorganic compound of a metal, non-metal, or metalloid.

4. The projectile according to claim 3, wherein the ceramic tip is an oxide, non-oxide, or composite cermet.

5. The projectile according to claim 1, wherein the Vickers hardness of the ceramic tip is greater than 550HV.

6. The projectile according to claim 5, wherein the Vickers hardness is greater than 1000 HV.

7. The projectile according to claim 1, wherein the ceramic tip is formed by additive layer manufacture, solidification of molten salts, chemical synthesis, sintering, and/or isostatic pressing.

8. The projectile according to claim 4, wherein the ceramic tip is selected from one or more oxides of alumina and/or zirconia, or one or more non-oxide carbides and/or nitrides.

9. The projectile according to claim 1, wherein the ceramic tip has a physical or chemical bond to the elongate metal core.

10. The projectile according to claim 9, wherein the physical or chemical bond comprises fusion, adhesive, plasma deposition, and/or additive layer manufacture.

11. The projectile according to claim 1, wherein the ceramic tip is less than 10% of the fill volume of the inner cavity.

12. The projectile according to claim 1, wherein the ceramic tip has a first end which engages with the elongate metal core and a second end which has a taper with respect to the first end.

13. The projectile as claimed in claim 1, wherein said deformable jacket or coating forms the outer diameter of said projectile and is substantially equal to an internal diameter of the barrel defined by lands of rifling in the rifled barrel, and wherein during firing of the projectile the lands of the rifling in the rifled barrel deform the deformable jacket or coating such as to impart spin on the projectile.

14. The projectile as claimed in claim 13, wherein upon firing deformation of the deformable jacket or coating is configured to provide the projectile with an interference fit with the lands of the rifling so as to provide effective obturation by restricting or preventing the escape of propellant gases past the projectile via grooves between the lands of the rifling.

15. The combination of a gun having a rifled barrel and a round of ammunition as defined in claim 1; wherein the rifled barrel comprises rifling grooves which are separated by rifling lands extending helically along a length of the barrel; the projectile having an outer diameter substantially equal to or less than an internal diameter of the barrel defined by the rifling lands, and wherein during firing of the projectile the deformable jacket or coating is deformed by the rifling lands of the barrel into the rifling grooves.

16. A projectile with a nominal calibre, for use in a rifled barrel, the projectile comprising:

an elongate metal core;

a ceramic tip with a Vickers Hardness greater than said elongate metal core, said ceramic tip having a first end which engages with the elongate metal core and a second end which has a taper with respect to the first end; and a deformable metal jacket that surrounds the elongate metal core and the ceramic tip, such that said deformable jacket defines the nominal calibre of said projectile, wherein said deformable metal jacket defines an inner cavity in the projectile, and the ceramic tip is in a range of from 5 to 25% of a fill volume of the inner cavity, wherein during firing of the projectile lands of rifling in the rifled barrel deform the deformable metal jacket so as to impart spin on the projectile, and wherein during firing of the projectile the deformable metal jacket is deformed into the grooves of the rifling in the barrel.

17. The projectile according to claim 16, wherein:

the elongate metal core includes lead, steel, tungsten, an alloy of tungsten, or tungsten carbide;

the ceramic tip includes an oxide comprising alumina, an oxide comprising zirconia, a non-oxide carbide, or a non-oxide nitride; and the Vickers hardness of the ceramic tip is greater than 550HV.

18. A projectile with a nominal calibre, for use in a rifled barrel, the projectile comprising:

an elongate metal core;

a ceramic tip with a Vickers Hardness greater than said elongate metal core, said ceramic tip having a first end which engages with the elongate metal core and a second end which has a taper with respect to the first end; and a deformable metal coating that surrounds the elongate metal core and the ceramic tip, such that said deformable metal coating defines the nominal calibre of said projectile, wherein said deformable metal coating defines an inner cavity in the projectile, and the ceramic tip is in a range of from 5 to 25% of a fill volume of the inner cavity, wherein during firing of the projectile lands of rifling in the rifled barrel deform the deformable metal coating so as to impart spin on the projectile, and wherein during firing of the projectile the deformable metal coating is deformed into the grooves of the rifling in the barrel.

19. The projectile according to claim 18, wherein:

the elongate metal core includes lead, steel, tungsten, an alloy of tungsten, or tungsten carbide;

the ceramic tip includes an oxide comprising alumina, an oxide comprising zirconia, a non-oxide carbide, or a non-oxide nitride; and the Vickers hardness of the ceramic tip is greater than 550HV.

20. A projectile with a nominal calibre, for use in a rifled barrel, the projectile comprising:

an elongate metal core;

a ceramic tip with a Vickers Hardness greater than said elongate metal core, said ceramic tip abutted with one end of the elongate metal core; and a deformable jacket or coating that surrounds the elongate metal core and the ceramic tip, such that said deformable jacket or coating defines the nominal calibre of said proj ectile;

wherein the ceramic tip has a physical or chemical bond to the elongate metal core, the physical or chemical bond comprising fusion, adhesive, plasma deposition, and/or additive layer manufacture.

* * * * *